US008574038B2

(12) United States Patent
Jespersen

(10) Patent No.: US 8,574,038 B2
(45) Date of Patent: Nov. 5, 2013

(54) MACHINING TOOL WITH SECURED REPLACEABLE TOOL ELEMENTS

(75) Inventor: Poul Erik Jespersen, Roslev (DK)

(73) Assignee: Flex Trim A/S, Roslev (DK)

( * ) Notice: Subject to any disclaimer, the term of this patent is extended or adjusted under 35 U.S.C. 154(b) by 412 days.

(21) Appl. No.: 12/734,942

(22) PCT Filed: Dec. 4, 2008

(86) PCT No.: PCT/DK2008/050290

§ 371 (c)(1),
(2), (4) Date: Jul. 12, 2010

(87) PCT Pub. No.: WO2009/071092

PCT Pub. Date: Jun. 11, 2009

(65) Prior Publication Data

US 2010/0297922 A1 Nov. 25, 2010

(30) Foreign Application Priority Data

Dec. 4, 2007 (DK) ..... 2007 01735

(51) Int. Cl.
*B24D 9/02* (2006.01)

(52) U.S. Cl.
USPC ..... 451/465; 451/466; 451/469

(58) Field of Classification Search
USPC ..... 451/463, 465–469, 490
See application file for complete search history.

(56) References Cited

U.S. PATENT DOCUMENTS

| | | | | |
|---|---|---|---|---|
| 3,678,633 | A * | 7/1972 | Block | 451/469 |
| 4,080,714 | A * | 3/1978 | Emerson | 29/509 |
| 4,090,333 | A * | 5/1978 | Block et al. | 451/468 |
| 4,445,248 | A | 5/1984 | Hait | |
| 7,056,201 | B2 * | 6/2006 | Jespersen | 451/465 |
| 2006/0014482 | A1 * | 1/2006 | Wentworth et al. | 451/466 |

FOREIGN PATENT DOCUMENTS

| | | |
|---|---|---|
| DE | 1 234 186 | 2/1967 |
| DE | 1234186 | 2/1967 |
| EP | 1 509 365 | 7/2006 |
| EP | 1509365 | 7/2006 |

* cited by examiner

*Primary Examiner* — Dung Van Nguyen
(74) *Attorney, Agent, or Firm* — James Creighton Wray

(57) ABSTRACT

The invention concerns a rotating sanding/grinding/polishing tool (1) provided with a number of undercut mounting grooves (5) for mounting one or more displaceable grinding elements (4), at which is provided an annular groove (8) in a plane largely perpendicularly to the rotary axis of the tool, and a ring-shaped securing means (9) provided in the groove and a resilient means (11) along the periphery of the rotating tool (1), at which the securing means (9) has one side bearing against the resilient means (11) and another side bearing against part of the grinding elements (4).

9 Claims, 5 Drawing Sheets

MACHINING TOOL WITH SECURED REPLACEABLE TOOL ELEMENTS

This application claims the benefit of Danish Application No. PA 2007 01735 filed Dec. 4, 2007 and PCT/DK2008/050290 filed Dec. 4, 2008, which are hereby incorporated by reference in their entirety as if fully set forth herein.

FIELD OF THE INVENTION

The present invention concerns a rotating sanding/grinding/polishing tool provided with a number of undercut mounting grooves which are adapted for mounting one or more displaceable grinding elements in use, at which is provided an annular groove in a plane largely perpendicularly to the rotary axis of the tool, and a ring-shaped resilient means provided in the groove along the periphery of the rotating tool, the tool being cylindric.

BACKGROUND OF THE INVENTION

When using rotating sanding/grinding/polishing tools where an elastic means is provided in an annular groove for securing the displaceable grinding elements, it has appeared that there is considerable wear on the elastic means. This means that there is a large consumption of these elastic means which moreover have to be checked regularly in order to avoid failure during operation.

From DE laid-open publication 1 234 186 is known a dish brush for a sweeping machine, where each single brush item is mounted in a rail fastened annularly on the outer upwardly angled ring face of the dish brush, where at one end of the lateral parts of the rails there are cutouts intended for receiving a locking wire which has the purpose of preventing the brush members from falling out of the groove when the brush is not in use. Due to the centrifugal force, the brush members will be forced out against the circumferential edge of the dish brush during operation of the brush. There is no mentioning of any kind of annular groove for receiving a resilient means or a locking means or any mentioning of the designing of the properties of the locking wire for ready replacement of the brush members.

OBJECT OF THE INVENTION

It is the object of the invention to provide a rotating sanding/grinding/polishing tool that enables a secure retention of the displaceable grinding elements while at the same time preventing wear from the grinding elements on the elastic means without substantially impeding easy and rapid replacement of the grinding elements.

DESCRIPTION OF THE INVENTION

According to the present invention, this is achieved by a rotating sanding/grinding/polishing tool of the kind mentioned in the introduction, which is peculiar in that a ring-shaped securing means is provided in the annular groove with one side bearing against the resilient means and in use with part of another side bearing against part of the grinding elements.

In the following, the combination of the elastic means and the securing means is termed a stop means as a unit.

The annular groove in which the stop means is disposed is arranged perpendicularly to the rotary axis of the tool and along the periphery of the cylindric tool. The annular groove will thereby cross all the undercut mounting grooves. The shape and depth of the annular groove depends on and is adapted to the stop means. The stop means may hereby be received in the annular groove in axially retained position such that at least part of the stop means bears against the end faces of the grinding elements. By using an annular groove there is achieved high certainty of retention of the grinding elements since less demands are put on the elasticity of the resilient means. In all embodiments, the stop means is be so dimensionally stable that it will not open or be flung out under the action of the centrifugal force coming from rotation during use of the tool.

The annular groove is designed such that it may absorb possible axial forces with which the elastic means are acting on the securing means. This means that the annular groove is designed with a contact face for the side of the securing means facing oppositely the side of the securing means bearing against the resilient means.

Since the annular groove is crossing the undercut mounting grooves, a part of the securing means will bear against the grinding elements opposite the mounting grooves, and the remaining part of the side of the securing means will bear against the cylindric tool.

In order to achieve retention of the displaceable grinding elements in the mounting grooves in the tool and in order to avoid wear on the elastic means, the tool is designed such that the securing means is disposed between the displaceable grinding elements and the elastic means. The securing means is retained by the resilient means, while the securing means prevents contact between the grinding elements and the resilient means by its disposition whereby wear on the resilient means coming from such contact is prevented while simultaneously ensuring retention of the grinding elements.

It is still possible to replace the grinding elements easily and rapidly in that besides removing the resilient means as by the prior art, it is only necessary to remove the securing means which is released when the resilient means is removed, after which access is provided for removing the displaceable grinding elements.

The cylindric tool is preferably designed as a cylinder with a circular cross-section. The cylindric tool may have different diameter along its length, in particular at the position of the stop means.

The mounting grooves for the grinding elements may be provided in the cylindric surface of the cylindric tool and have an axial orientation such that the grinding elements bear against a lateral face of the securing means.

The mounting grooves are disposed in one end face of the cylindric tool and have a radial orientation. In this case, the end face will be the end face closest to the securing means and farthest from a shaft and drive mechanism. The grinding elements bear against the inner circular face of the securing means.

The securing means has to be made of a relatively hard material. By relatively is meant that the securing means is to be made of a material which is harder than the resilient means. The securing means may e.g. be made of one or more of the following materials: metal, plastic or composite. It is important that the selected material is relatively wear resistant in order to ensure good durability of the securing means, as well as dimensionally stable in order to ensure good retention of the grinding elements.

The securing means may be designed either as a closed or as an open ring. It is preferred that the securing means is designed as a circular ring having a rectangular cross-section with two side faces and an outer an inner face, respectively. Alternatively, the securing means may be designed with any circular or polygonal cross-section.

The elastic means may e.g. be an O-ring, a locking ring or more of the following: an elastic band, a rubber band and/or a textile.

The elastic O-ring is preferably made of rubber, but may alternatively be made of plastic material, a metal alloy and/or a textile. The only requirement is that the O-ring by placing in the annular groove is to tighten around the annular groove so that it is secured during rotation of the cylindric tool, and that it is possible to expand the O-ring sufficiently enough such that it may be removed from the annular groove when a replacement of the grinding elements is to take place.

If the resilient means is an elastic locking ring, this has to be designed such that it is possible to expand the locking ring so much that it can be mounted and dismounted in the annular groove. The lock ring may typically be made of spring steel, or another metal alloy and/or plastic mixture having resilient action.

Alternatively, in an embodiment there may be used a strap which is placed and clamped in the annular groove. In order to replace the grinding elements, the strap is typically to be broken. This provides that the strap is to be produced inexpensively and not be complicated. This strap may e.g. be a clamp, a rubber band, a cord, and/or a strip.

In the embodiment where the mounting grooves are disposed in the cylinder face of the cylindric tool, an annular groove may advantageously be provided with a stop means at both ends of the cylindric tool as end stops for the grinding elements.

In the end face of the cylindric tool which is closest to the annular groove, there may advantageously be provided a number of cutouts which facilitate removal of the resilient means.

The end face may be concave or convex. This depends on the task to which the grinding/polishing tool is designed. Normally, this will only find application on the end face at which the grinding elements are disposed.

If there is space in longitudinal direction of the tool, replacement of the grinding elements may take place while the tool is suspended in a drive unit with a possible support unit.

The invention is explained more closely in the following with reference to the drawings, where:

DETAILED DESCRIPTION OF THE PREFERRED EMBODIMENTS

Figure 1:
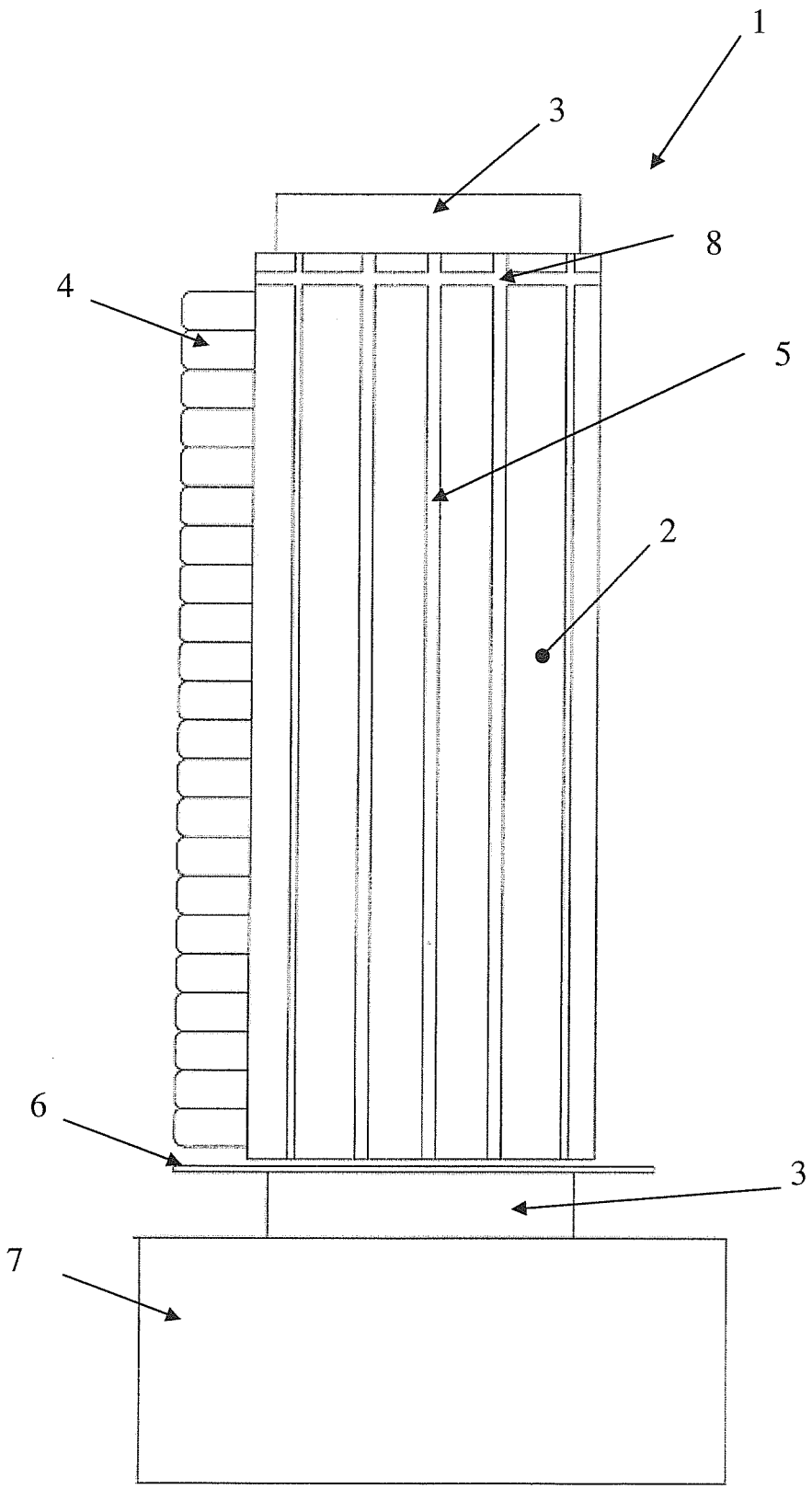
FIG. 1 shows a side view of the rotating grinding/sanding/polishing tool with grinding elements mounted on the cylinder face according to the invention.

The side view shown in FIG. 1 of the rotating grinding/sanding/polishing tool 1 shows a cylinder which includes a cylinder surface 2 and a shaft 3. On the cylinder surface 2 there are provided a number of mounting grooves 5 in which the grinding elements 4 are mounted.

In the embodiment shown, an annular groove 8 is provided in the cylinder surface 2 in vicinity of one end of the cylindric tool. The annular groove 8 crosses all mounting grooves 5.

One end of the cylindric tool is connected to an end plate 6 providing that the grinding elements 4 cannot be longitudinally displaced farther than to the plate 6. A further stop means with associated annular groove may be used as alternative to this end plate. In connection with the plate 6 and the shaft 3 there is mounted a drive unit 7. The opposite end is shown with a projecting shaft 3. The cylindric tool and/or the shaft 3 may be connected to a support unit (not shown). The end closest to the projecting shaft may be designed with cutouts in the end face (not shown).

Figure 2:
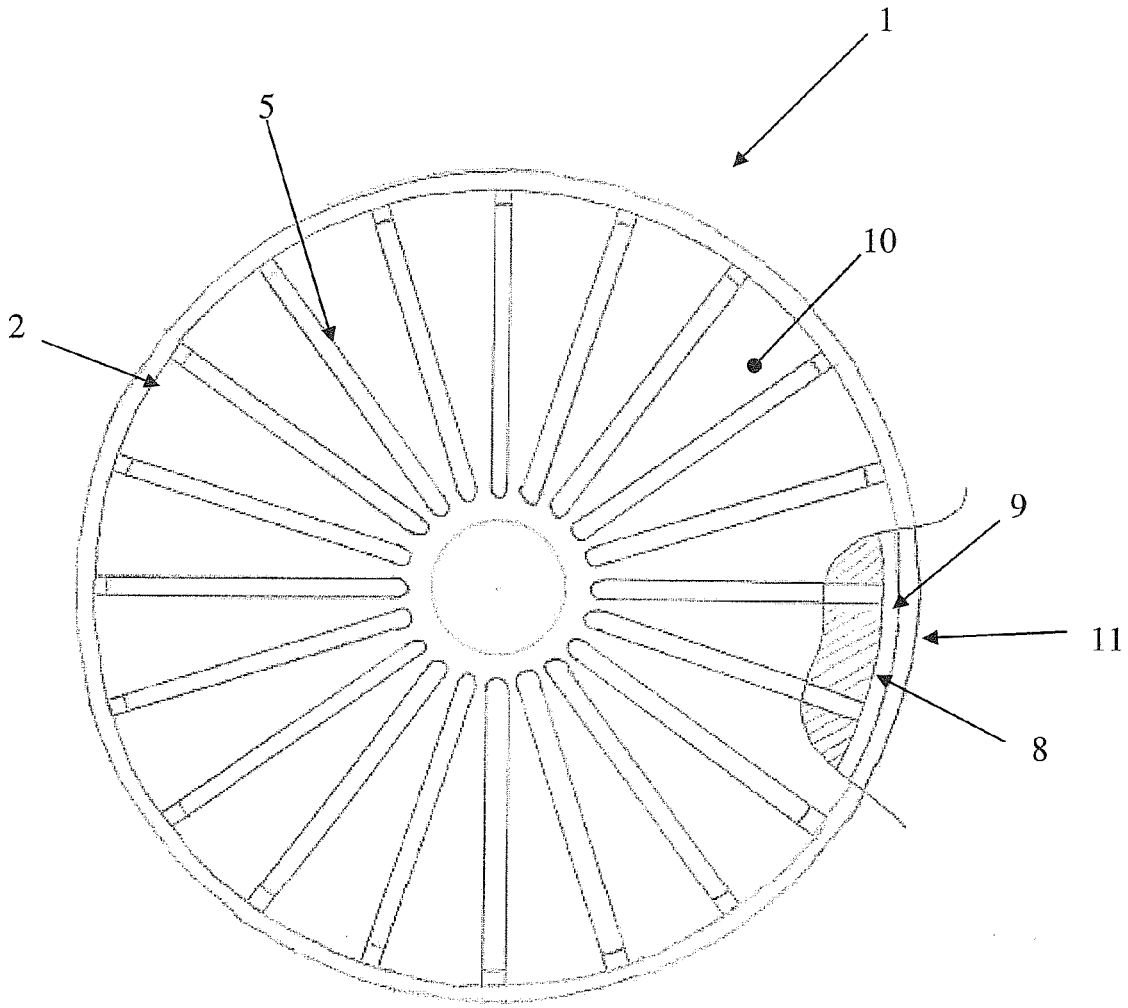
FIG. 2 shows a side view of the rotating grinding/polishing tool with grinding elements mounted on an end face of the cylindric tool according to the invention.

FIG. 2 shows a second embodiment of the rotating grinding/polishing tool 1, wherein a number of mounting grooves 5 are provided on an end face 10 of the cylindric tool 1. The grinding elements (not shown) are mounted in these mounting grooves 5, innermost bearing against an end stop provided by the special design of the mounting grooves, and outermost by bearing against the securing means 9. The securing means 9 bears against the resilient means 11 such that the securing means 9 is retained and axial displacement of the securing means 9 is rendered impossible.

The securing means 9 and the resilient means 11 are provided in an annular groove 8 provided in the cylinder surface 2 in vicinity of one end of the cylindric tool. The annular groove 8 crosses all mounting grooves 5.

Figure 3:
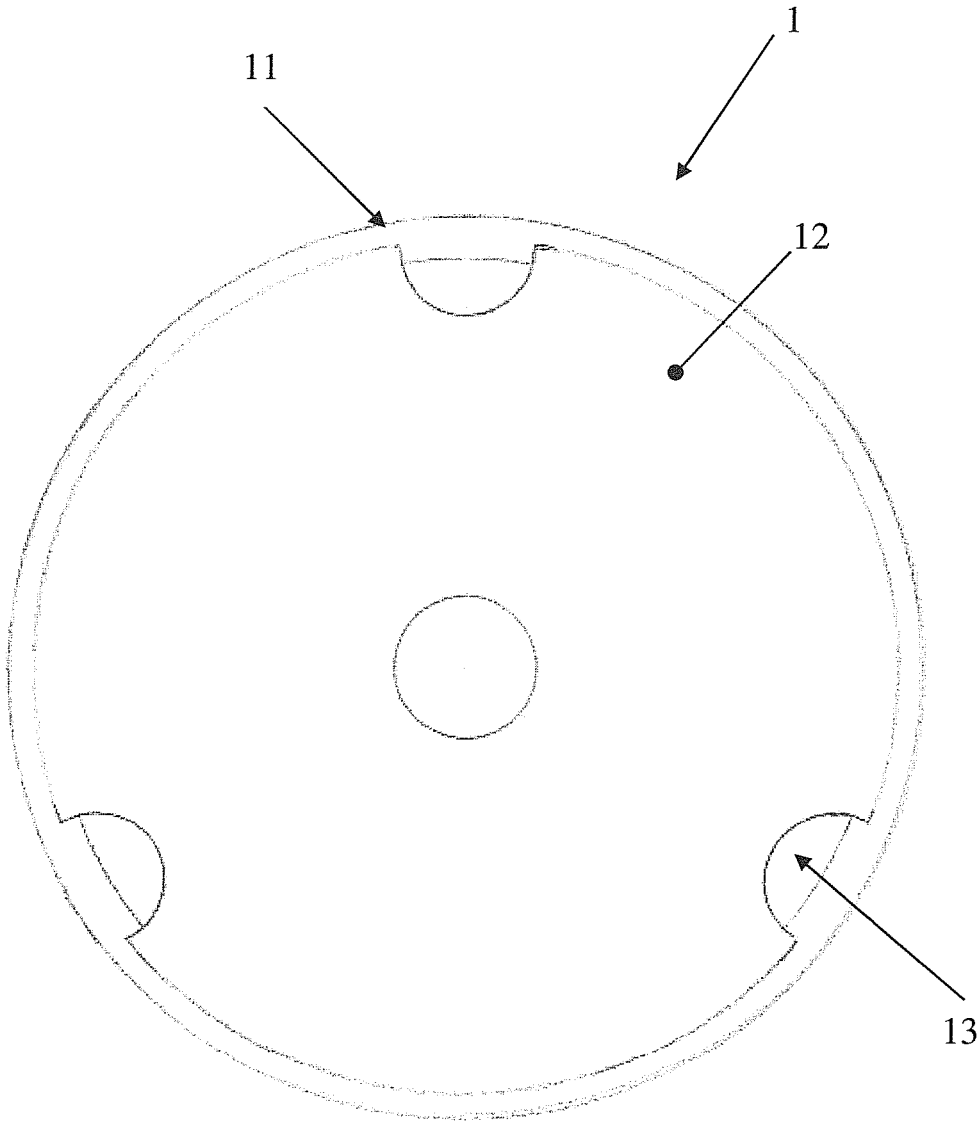
FIG. 3 shows a side view of the rotating grinding/polishing tool with cutouts in the end face according to the invention.

In this embodiment, the end face 10 will be the surface opposite a shaft and drive unit. FIG. 3 shows an end face 12 of the tool 1 in which is provided a number of cutouts 13 giving access to a larger part of the elastic means 11 than in the areas without cutouts.

In all embodiments of the invention, the end face 12 will be the term for the surface in immediate connection with the resilient means.

If two annular grooves are provided in an embodiment of the cylindric tool with associated stop means, it will be advantageous with cutouts in both end faces.

Figure 4:
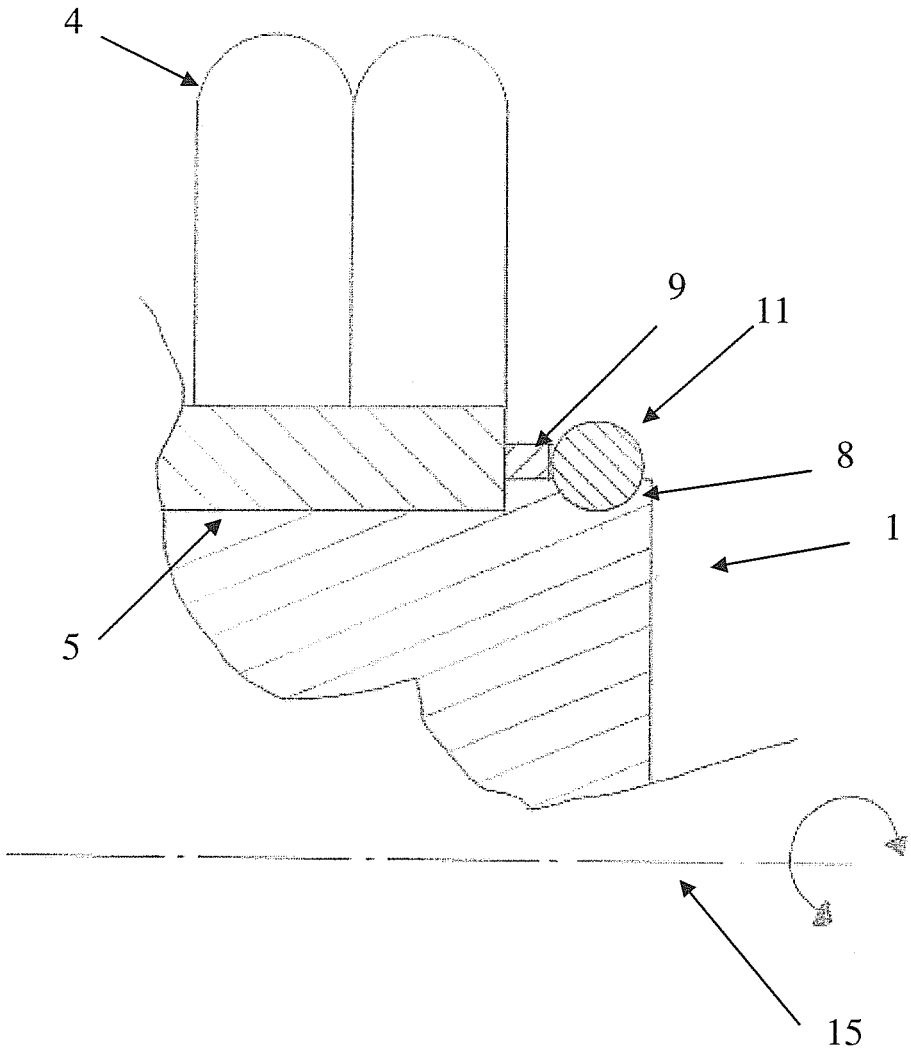
FIG. 4 shows a sectional view of the rotating grinding/polishing tool according to the invention.

On FIG. 4 is shown a cross-section of the cylindric tool 1 for an embodiment where the grinding elements 4 are provided on the cylinder surface 2 and bearing against one side of the securing means 9. The securing means 9 and the resilient means 11, here in the form of an O-ring, are disposed in the groove 8. The securing means 9 and the O-ring 11 interact as a stop for axial movements of the grinding elements 4. In the shown embodiment, the shape of the groove 8 is such that the O-ring 11 fits into the groove 8 while the upper part of the O-ring 11 is free of the groove 8, and the maximum diameter of the groove is less than or equal to the inner diameter of the securing means.

The rotary axis 15 of the tool is also shown on FIG. 4.

Figure 5:
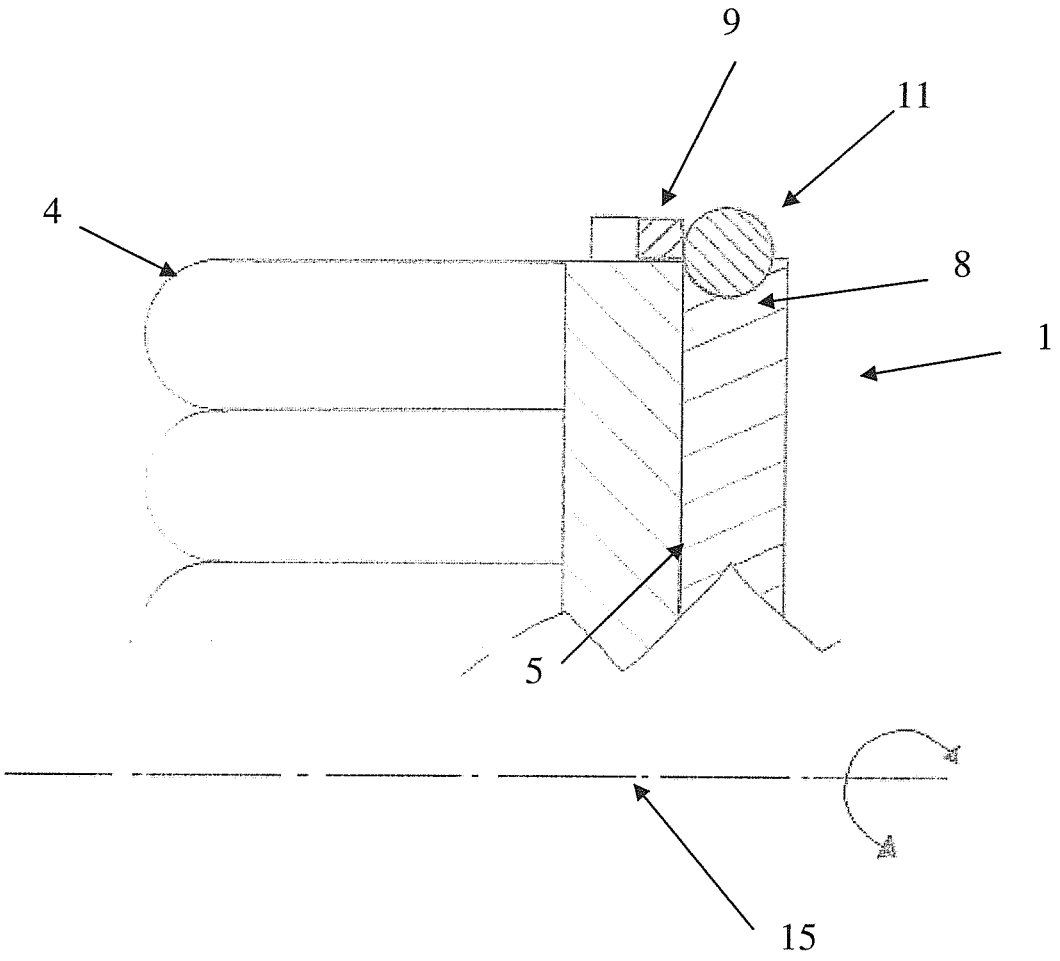
FIG. 5 shows a sectional view of the rotating grinding/polishing tool according to the invention.

On FIG. 5 is shown a cross-section of the cylindric tool 1 for an embodiment where the grinding elements 4 are provided on an end face of the cylindric tool 1, bearing against the inner surface of the securing means 9. The securing means 9 and the resilient means 11, here in the form of an O-ring, are disposed in the groove 8. The securing means 9 and the O-ring 11 interact as a stop for radial movements of the grinding elements 4. In the shown embodiment, the shape of the groove 8 is such that the O-ring 11 fits into the groove 8 while the upper part of the O-ring 11 is free of the groove 8, and the maximum diameter of the groove 8 is less than or equal to the inner diameter of the securing means on the part of the groove 8 located under the securing means 9 and adjacent to the end face 12 of the cylindric tool 1. The securing means 9 may hereby be mounted and dismounted, respectively.

The rotary axis 15 of the tool is also shown on FIG. 5.

The invention is not limited to the embodiments shown and described above in the Figures. Other embodiments including other designs of grooves and securing and resilient means are possible within the scope of this invention and the matter specified in the claims.

The invention claimed is:

1. A rotating sanding/grinding/polishing tool (1) provided with a number of undercut mounting grooves (5) which are adapted for mounting one or more displaceable grinding elements (4) in use, at which is provided an annular groove (8) in a plane largely perpendicularly to the rotary axis of the tool, and a ring-shaped resilient element (11) provided in the groove along the periphery of the rotating tool (1), the tool (1) being cylindric, wherein a ring-shaped securing element (9) is provided in the annular groove (8) with one side bearing, against the resilient element (11) and in use with part of another side bearing against part of the grinding elements (4).

2. Rotating sanding/grinding/polishing tool according to claim 1, wherein the mounting grooves (5) are disposed in the cylinder surface (2) of the cylindric tool and have an axial orientation.

3. Rotating sanding/grinding/polishing tool according to claim 1, wherein the securing element (9) is made of a relatively hard material, such as selected from the group consisting of metal, plastic and composite.

4. Rotating sanding/grinding/polishing tool according to claim 1, wherein the securing element (9) is designed either as a closed or an open ring.

5. Rotating sanding/grinding/polishing tool according to claim 1, wherein the resilient element (11) is an O-ring.

6. Rotating sanding/grinding/polishing tool according to claim 1, wherein the resilient element (11) is a locking ring.

7. Rotating sanding/grinding/polishing tool according to claim 1, wherein cutouts (13) are formed in an end face (12) of the cylindric tool at the annular groove (8), the end face being closest to the resilient element.

8. Rotating sanding/grinding/polishing tool according to claim 1, wherein the end face (10) of the cylindric tool is concave or convex.

9. A rotating sanding/grinding/polishing tool (1) provided with a number of undercut mounting grooves (5) which are adapted for mounting one or more displaceable grinding elements (4) in use, at which is provided an annular groove (8) in a plane largely perpendicularly to the rotary axis of the tool, and a ring-shaped resilient element (11) provided in the groove along the periphery of the rotating tool (1), the tool (1) being cylindric, wherein a ring-shaped securing element (9) is provided in the annular groove (8) with one side bearing, against the resilient element (11) and in use with part of another side bearing against part of the grinding elements (4), wherein the mounting grooves (5) are disposed in one end face (10) of the cylindric tool with a radial orientation, the end face being closest to the securing element.

* * * * *